US005610327A

United States Patent [19]

Becker et al.

[11] Patent Number: 5,610,327

[45] Date of Patent: Mar. 11, 1997

[54] KNOCK SENSOR-TRIGGERED TIMING LIGHT WITH VISIBLE LASER RETRO-REFLECTING CONTROL

[75] Inventors: Thomas P. Becker; Mark A. Hoferitza; Matthew M. Crass, all of Kenosha, Wis.

[73] Assignee: Snap-on Technologies, Inc., Crystal Lake, Ill.

[21] Appl. No.: 486,328

[22] Filed: Jun. 7, 1995

[51] Int. Cl.[6] ..... F02P 17/00

[52] U.S. Cl. ..... 73/117.3; 73/5; 324/392; 324/402

[58] Field of Search ..... 73/5, 35.03, 35.04, 73/35.06, 35.09, 117.2, 117.3, 504.01, 514.26, 514.27; 324/391, 392, 401, 402

[56] References Cited

U.S. PATENT DOCUMENTS

| | | | |
|---|---|---|---|
| 3,857,086 | 12/1974 | Mooney et al. . | |
| 4,079,311 | 3/1978 | Roth . | |
| 4,106,461 | 8/1978 | Giannini . | |
| 4,128,005 | 12/1978 | Arnston et al. | 73/117.3 |
| 4,185,494 | 1/1980 | Yelke | 73/119 A |
| 4,266,427 | 5/1981 | Wesley | 73/119 A |
| 4,296,471 | 10/1981 | Goux . | |
| 4,413,508 | 11/1983 | Kawamura et al. . | |
| 4,417,211 | 11/1983 | Ciriacks et al. . | |
| 4,423,624 | 1/1984 | Dooley et al. . | |
| 4,441,360 | 4/1984 | Dooley et al. . | |
| 4,466,407 | 8/1984 | Aures et al. . | |
| 4,517,833 | 5/1985 | Wesley | 73/119 A |
| 4,713,617 | 12/1987 | Michalski | 73/499 |
| 4,775,816 | 10/1988 | White et al. . | |
| 4,890,592 | 1/1990 | Furuyama et al. . | |

*Primary Examiner*—Richard Chilcot
*Assistant Examiner*—Eric S. McCall
*Attorney, Agent, or Firm*—Emrich & Dithmar

[57] ABSTRACT

A diesel timing light includes a flash circuit for flashing a xenon lamp in response to ignition events sensed by a knock sensor. A trigger circuit enables the flash circuit only in the presence of an enable signal, which is generated by a sensing circuit immediately before the ignition of the no. 1 cylinder. The sensing circuit includes a visible laser source which illuminates a patch of reflective tape on the engine flywheel just ahead of a timing mark corresponding to engine top dead center. The tape reflects the visible laser light to a sensor which generates the enable signal. The trigger disables the flash circuit immediately after the flash triggered by the first ignition event after the enable signal. LED indicators indicate when the photosensor is detecting the reflected beam and when the knock sensor is detecting ignition events.

20 Claims, 3 Drawing Sheets

KNOCK SENSOR-TRIGGERED TIMING LIGHT WITH VISIBLE LASER RETRO-REFLECTING CONTROL

BACKGROUND OF THE INVENTION

1. Field of the Invention

The present invention relates to timing lights for monitoring the timing of events in internal combustion engines. The invention is particularly concerned with timing lights for use with diesel engines.

2. Description of the Prior Art

High intensity strobe lights, called timing lights, are used in conjunction with timing marks or indicia on the block and on an adjacent rotating part of an internal combustion engine for timing the ignition of the no. 1 cylinder. In spark-ignited engines, the timing light is triggered by the no. 1 spark plug signal. However, in the case of diesel engines, timing is more difficult, since there is no spark plug from which to obtain the ignition signal.

Timing lights for diesel engines have been triggered by pressure sensors adapted to mate with the glow plug receptacle of a diesel engine cylinder to sense the pressure resulting from combustion in the cylinder. Also, trigger circuits have been provided for detecting the point in time at which an injector nozzle begins to open to inject fuel into the cylinder. However, in many cases, the no. 1 cylinder is not readily accessible.

It is known to utilize a vibration sensor, such as a knock sensor, to detect engine vibrations resulting from the pressure of cylinder combustion. However, such sensors detect the ignition events for all cylinders whereas, for purposes of triggering a timing light, only the no. 1 cylinder ignition event is of interest.

SUMMARY OF THE INVENTION

It is a general object of the invention to provide an improved timing light for diesel engines, which avoids the disadvantages of prior timing light arrangements while affording additional structural and operating advantages.

An important feature of the invention is the provision of a diesel timing light which does not require access to the no. 1 cylinder.

In connection with the foregoing feature, a further feature of the invention is the provision of a diesel timing light of the type set forth, which can be usefully triggered by a vibration sensor.

In connection with the foregoing features, still another feature of the invention is the provision of a timing light of the type set forth, which is responsive to only vibrations resulting from ignition events in a cylinder of interest.

Yet another feature of the invention is the provision of a timing light control apparatus which enables the timing light trigger just before the occurrence of an ignition event of interest and disables it immediately after that ignition event.

In connection with the foregoing feature, a further feature of the invention is the provision of an apparatus of the type set forth, which utilizes a light beam reflected from a moving part of the engine to enable the timing light.

Certain ones of these and other features of the invention are attained by providing in a timing light, which includes a flash circuit for producing a flash of illumination in response to an ignition event of an internal combustion engine, the improvement comprising: a trigger circuit coupled to the flash circuit for enabling the flash circuit only in the presence of an enable signal, and a sensing circuit adapted to be coupled to the engine for sensing that an ignition event of interest is about to occur and responsive to such sensing for generating the enable signal.

Further features of the invention are attained by providing apparatus for controlling a timing light for use with an internal combustion engine which has periodic ignition events and which includes an accessible member rotatable through an integer number of revolutions during each engine operating cycle and bearing a first indicium which aligns with a fixed second indicium on the engine once during each revolution of the member, the apparatus comprising: an ignition sensor coupled to the engine for sensing ignition events, a first light source, a flash circuit coupled to the ignition sensor and to the first light source for producing a flash of illumination in response to an ignition event, a trigger circuit coupled to the flash circuit for enabling the flash circuit only in the presence of an enable signal, a second light source adapted for directing an incident beam of light onto the accessible member, a reflective portion on the accessible member disposed so as to be illuminated by the incident beam of light once during each revolution of the member to produce a reflected beam of light, the reflective portion being so positioned on the member that it aligns with the second indicium just prior to alignment of the first indicium with the second indicium, and a photosensing circuit coupled to the trigger circuit and disposed in the path of the reflected beam of light for generating the enable signal in response to the reflected beam of light.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
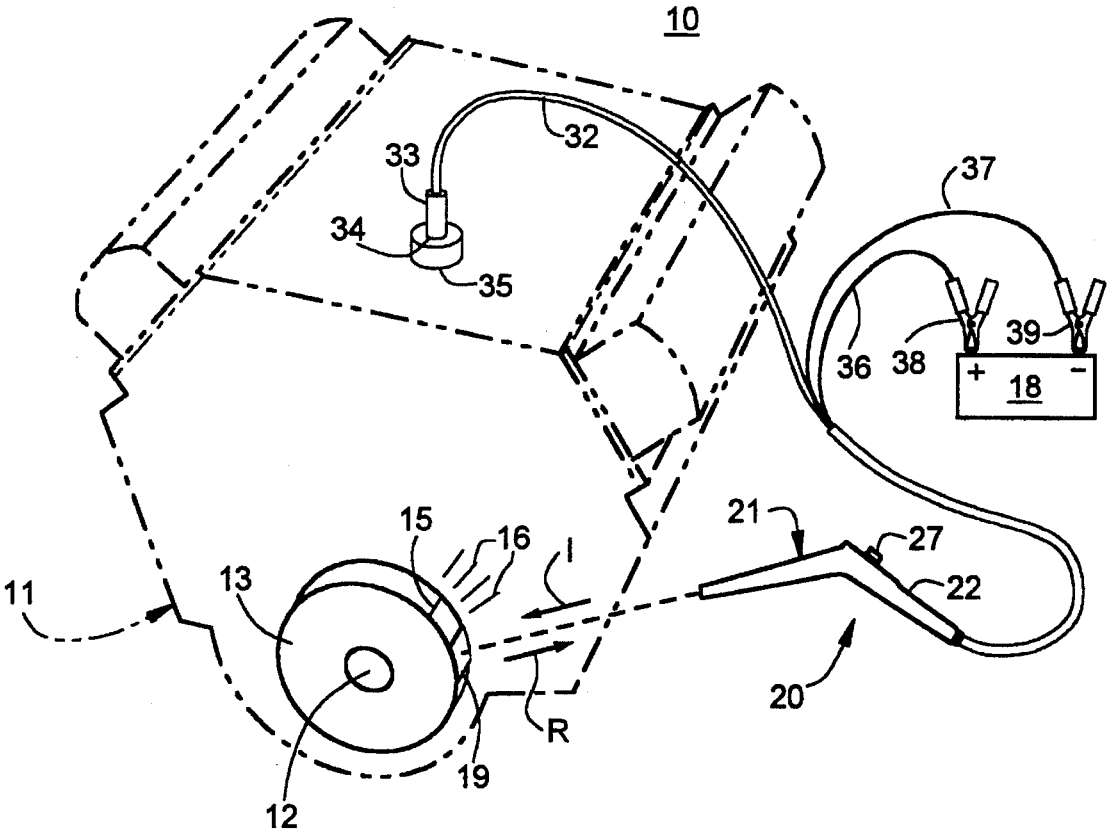
FIG. 1 is a perspective view of the timing light of the present invention, shown coupled to a diesel engine illustrated in phantom.

Referring to FIG. 1, there is illustrated a diesel engine 10 having a block 11 and a drive shaft 12, to which is mounted a flywheel 13. Provided on the peripheral surface of the flywheel 13 is a timing mark 15. Provided on the block 11 adjacent to the flywheel 13 is a series of scale marks 16 for use in conjunction with the timing mark 15 for monitoring engine timing, in a known manner. Typically, the engine 10 will be mounted in a vehicle which is provided with a battery 18. It is a fundamental aspect of the present invention that a patch of retroreflective tape 19 is adhesively secured to the peripheral surface of the flywheel 13, a slight distance ahead of the timing mark 15, for a purpose which will be explained more fully below. For purposes of illustration, it is assumed that the flywheel 13 rotates in a clockwise direction, as viewed in FIG. 1, and the term "ahead" means in the direction of rotation, so that the reflective tape 19 will pass the scale marks 16 before the timing mark 15 does.

Figure 2:
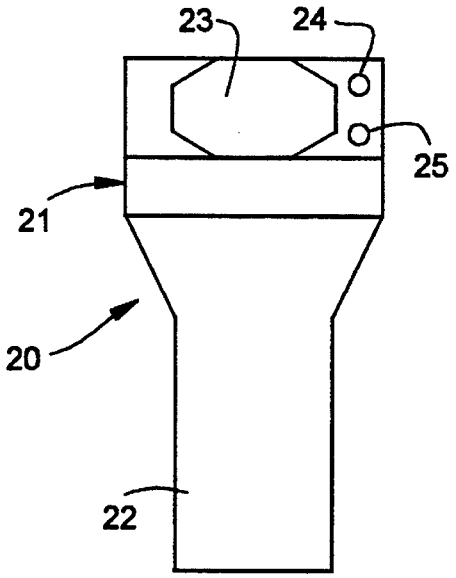
FIG. 2 is an enlarged front end elevational view of the timing light of FIG. 1.
Figure 3:
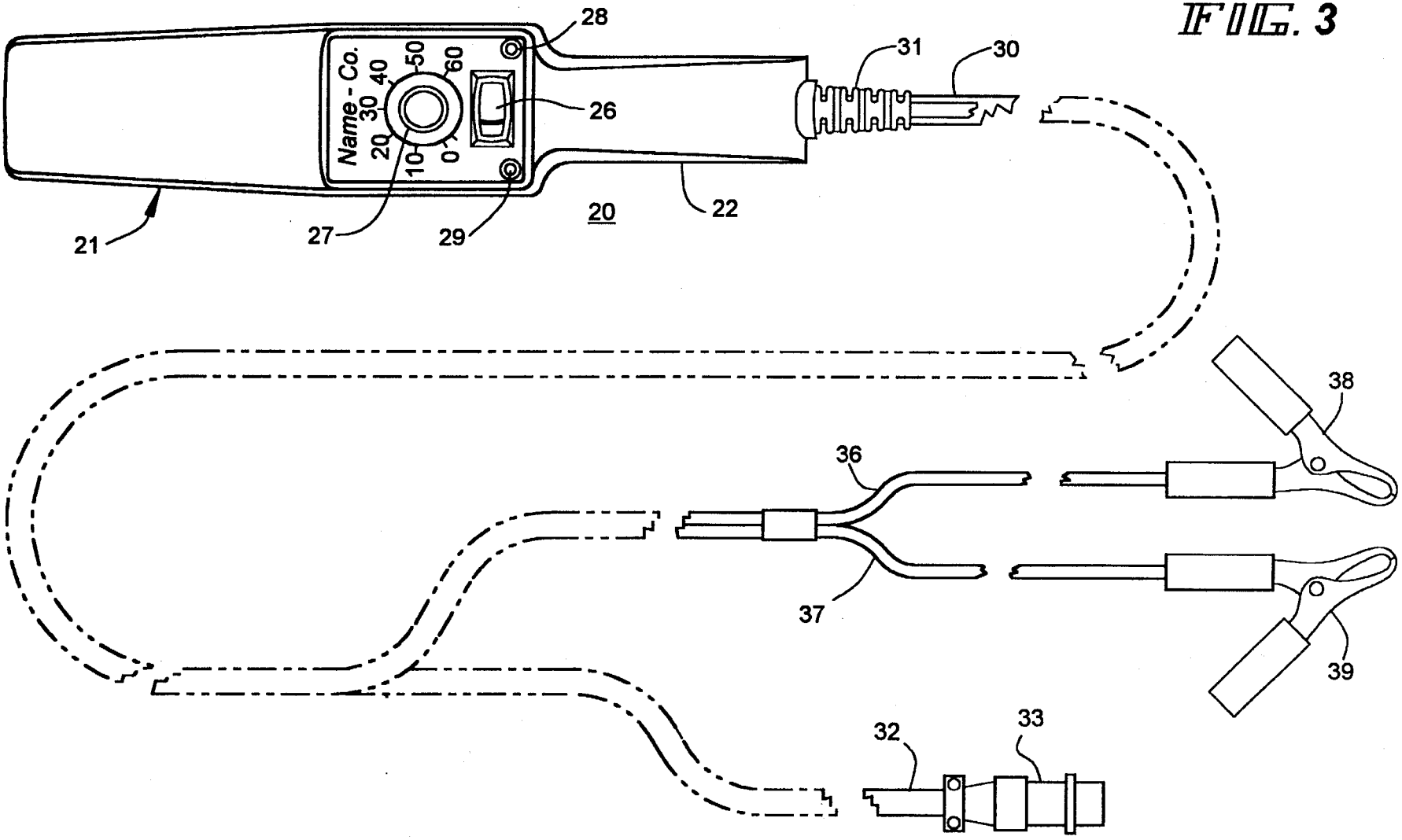
FIG. 3 is a top plan view of the timing light of FIG. 2 and associated cabling shown partially in phantom.

Referring to FIGS. 1–3, there is illustrated a timing light 20 constructed in accordance with and embodying the features of the present invention. The timing light 20 has a generally pistol-shaped housing 21 provided with a handle 22. A xenon lamp 23 is mounted in the forward end of the housing 21 for emitting light therefrom. Also mounted in the forward end of the housing 21 adjacent to the xenon lamp 23 are a light source, preferably in the form of a visible laser diode 24, and a photosensitive element, preferably in the form of a photodiode 25. Mounted at the upper end of the handle 22 is an ON-OFF switch 26 and a rotary knob or dial 27 which cooperates with associated indicia on the housing 21 for controlling the time period during which the xenon lamp 23 is enabled to flash, as will be explained more fully below. Mounted, respectively, at the right-hand and left-hand sides of the ON-OFF switch 26 are LED indicator lamps 28 and 29, the purposes of which will be explained below.

The timing light 20 is provided with a cable bundle 30 which exits the distal end of the handle 22 through a suitable strain relief 31. The cable bundle 30 includes a coaxial cable 32, the distal end of which is coupled to a suitable plug 33 for plugging into an associated socket 34 (FIG. 1) of a suitable vibration sensor, such as a knock sensor 35. The cable bundle 30 also includes cables 36 and 37, the distal ends of which are respectively connected to battery clamps 38 and 39 for coupling to the terminals of the battery 18 or other suitable DC source in a known manner.

Figure 4:
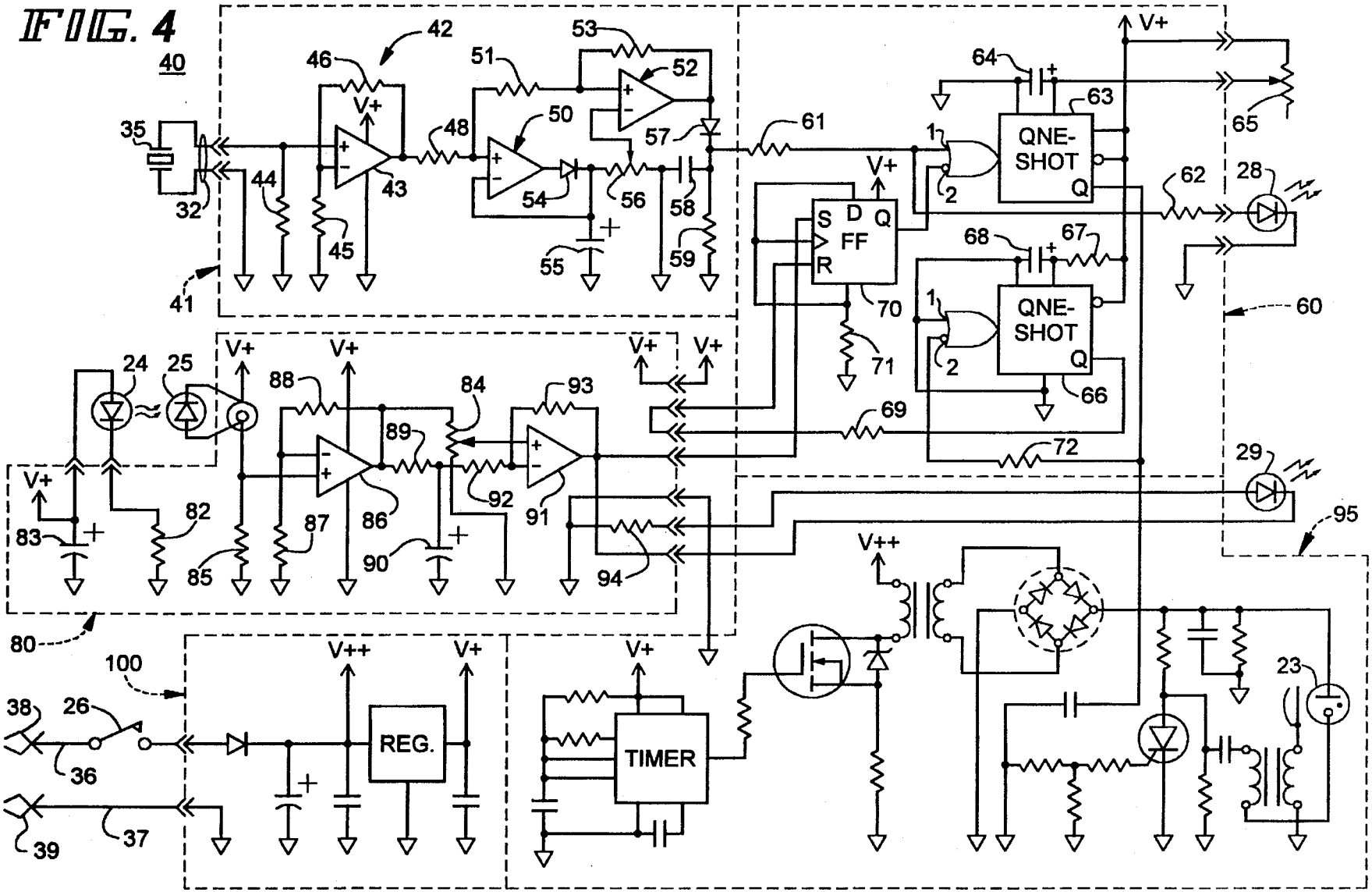
FIG. 4 is a schematic circuit diagram of the control circuit of the timing light of FIG. 1.

Referring also to FIG. 4, there is illustrated a control circuit 40 for the timing light 20, the circuit 40 preferably being on a suitable circuit board (not shown) disposed within the housing 21. The control circuit 40 includes an ignition sensor circuit 41 which is coupled to the coaxial cable 32 from the knock sensor 35. The ignition sensor circuit 41 includes a fixed-gain amplifier 42 which includes an op amp 43, the non-inverting terminal of which is connected to the signal from the knock sensor 35, the other conductor of the cable 32 being connected to ground. The non-inverting and inverting input terminals of the op amp 43 are also respectively connected to ground through resistors 44 and 45. The output of the op amp 43 is connected to the non-inverting input terminal thereof through a feedback resistor 46. The output of the amplifier 42 is also connected through a resistor 48 to the non-inverting input terminal of an op amp peak detector 50, which terminal is also connected through a resistor 51 to the non-inverting input terminal of an op amp comparator 52. A feedback resistor 53 is connected between the output and the non-inverting input terminal of the comparator 52. The output of the peak detector 50 is coupled to the anode of a diode 54, the cathode of which is connected to the inverting input terminal of the peak detector 50 and is also connected through a capacitor 55 to ground. The cathode of the diode 54 is also connected to one fixed terminal of a potentiometer 56, the wiper of which is connected to the inverting input terminal of the comparator 52. The output of the comparator 52 is coupled to the anode of a diode 57, the cathode of which is coupled through a capacitor 58 to the other fixed terminal of the potentiometer 56, which terminal is also connected to ground. The cathode of the diode 57 is also connected to ground through a resistor 59.

The control circuit 40 also includes a trigger circuit 60 which is coupled to the output of the ignition sensor circuit 41. More specifically, the cathode of the diode 57 is connected through resistors 61 and 62 to the anode of the LED 28, the cathode of which is connected to ground. The junction between the resistors 61 and 62 is also connected to input terminal 1 of a flash one-shot 63. Connected across the timing terminals of the one-shot 63 is a capacitor 64, the negative plate of which is grounded, and the positive plate of which is connected to the wiper of a potentiometer 65, which wiper is mechanically coupled to the dial 27. The potentiometer 65 is also connected to a V+ supply, which is also supplied to the one-shot 63, and to a reset one-shot 66. The V+ supply is also connected through a resistor 67 and a capacitor 68 to the input terminal 1 of the one-shot 66 and to ground, the capacitor 68 being connected across the timing terminals of the one-shot 66. The Q output of the one-shot 66 is connected through a resistor 69 to the reset terminal of a flip-flop 70, the D and clock terminals of which are connected to ground through a resistor 71. The Q output of the flip-flop 70 is connected to the input terminal 2 of the one-shot 63. The Q output of the one-shot 63 is connected through a resistor 72 to the input terminal 2 of the one-shot 66.

The control circuit 40 also includes a light emitter/detector circuit 80. More specifically, the V+ supply is connected to the anode of the visible laser diode 24, the cathode of which is connected to ground through a resistor 82. The anode of the diode 24 is also connected to ground through a power supply decoupling capacitor 83. The photodiode 25 has its cathode connected to the V+ supply and its anode connected through a load resistor 85 to ground, the anode also being connected to the non-inverting input terminal of an op amp amplifier 86. The inverting input terminal of the amplifier 86 is connected to ground through a resistor 87 and, through a resistor 88, to the output of the amplifier 86. The output of the amplifier 86 is also connected to ground through the series combination of a resistor 89 and capacitor 90. The output of the amplifier 86 is also connected to ground through a potentiometer 84, the wiper of which is connected to the non-inverting input terminal of an op amp comparator 91, the inverting input terminal of which is connected through a resistor 92 to the junction between the resistor 89 and the capacitor 90. The output of the comparator 91 is connected to its inverting input through a feedback resistor 93, and is also connected to the cathode of the LED 29, the anode of which is connected to ground through a resistor 94. The output of the comparator 91 is also connected to the set terminal of the flip-flop 70 of the trigger circuit 60.

The Q output of the flash one-shot 63 of the trigger circuit 60 is connected to a flash circuit 95, of known construction, for controlling the xenon lamp 23. The control circuit 40 also includes a power supply 100, which is coupled through the ON-OFF switch 26 to the battery clamp 38 for providing the V+ and V++ supply voltages which may, respectively, be 8 VDC and 12 VDC. The flash circuit 95 and the power supply 100 are well known and, therefore, their construction and operation will not be described in detail.

The op amps of the ignition sensor circuit 41 may be part of a common multiple-op amp chip and, therefore, the V+ supply is shown connected to only one of the op amps. The same is true for the op amps of the light emitter/detector circuit 80.

The purpose of the ignition sensor 41 is to convert the raw signal from the knock sensor 35 to a train of square wave pulses which the trigger circuit 60 uses to activate the flash circuit 95. The signal from the knock sensor 35 is fed to the amplifier 42, which preferably has a gain of 11, set by the resistors 45 and 46. The resistor 44 provides impedance matching between the sensor 35 and the amplifier 42. The output of the amplifier 42 is fed to the peak detector 50, the output of which charges the capacitor 55 through the rectifying diode 54 to the maximum voltage which appears at the input of the peak detector 50. The output of the peak detector 50 is attenuated by the potentiometer 56, the attenuated signal being applied to the comparator 52, which compares it to the output of the amplifier 42 and provides a positive output pulse when the amplifier output is greater than the attenuated peak signal. Resistors 51 and 53 establish hysteresis of the comparator 52. Capacitor 58 and resistor 59 function as a low-pass filter. The diode 57 isolates the input to the trigger circuit 60 from the filter circuit when there is no signal present, i.e., when the output of the comparator 52 is low. The LED 28 provides a visual confirmation that the ignition sensor circuit 41 is detecting ignition events and delivering output pulses to the trigger circuit 60. The resistor 62 provides current limiting. Thus, when the ignition sensor circuit 41 is operating properly, the LED 28 should flash once for each sensed ignition event, i.e., each cylinder combustion.

The purpose of the light emitter/detector circuit 80 is to detect the position of the engine flywheel 13 just prior to its top dead center ("TDC") position, thereby readying the trigger circuit 60 to activate the flash circuit 95 upon the next output pulse from the ignition sensor circuit 41. The resistor 82 provides current limiting for the visible laser diode 24. The visible laser diode 24 emits a beam of visible laser light from the front end of the timing light housing 21, which beam can be directed at the flywheel 13 so as to illuminate the retroreflective tape 19 once each revolution. The tape 19 is preferably about a one-inch square piece of tape which is positioned approximately one inch ahead of the timing mark 15, although it will be appreciated that the exact positioning can vary, depending upon the number of cylinders and the size of the flywheel 13. The incident beam emitted by the visible laser diode 24 is designated I in FIG. 1, and it is retroreflected from the retroreflective tape patch 19 to produce a reflected beam R, which is sensed by the photodiode 25. Resistor 85 serves as a load resistor for the photodiode 25, the output of which is applied to the amplifier 86, which preferably has a gain of about 3.9, as determined by the resistors 87 and 88. The output of the amplifier 86 is applied to the resistor 89 and capacitor 90, which serve as an averaging circuit, producing a signal representative of the ambient light level at the photodiode 25. The output of the amplifier 86 also feeds the non-inverting input of the comparator 91 through the potentiometer 84, which acts as a sensitivity adjustment. When the voltage at the non-inverting input terminal of the comparator 91 exceeds that of the inverting input terminal, the output goes high. This would occur when the light level detected by the photodiode 25 exceeds the average value by a percentage determined by the potentiometer 84. Resistors 92 and 93 are preferably selected to provide a gain of 100, shaping the square wave output of the comparator 91. The LED 29 provides visual conformation of detection of the reflected signal, with the resistor 94 providing current limiting. Thus, if the light emitter/detector circuit 80 is operating properly, when the visible laser beam is directed so as to illuminate the retroreflective tape patch 19, the LED 29 should flash once per revolution of the flywheel 13.

The purpose of the trigger circuit 60 is to process the signals from the ignition sensor circuit 41 and from the light emitter/detector circuit 80 to activate the flash circuit 95 only upon the occurrence of particular ignition events of interest and to disable the flash circuit 95 during other ignition events. The flip-flop 70 acts as a "ready" circuit. The output of the light emitter/detector 80 sets the flip-flop 70, and it is reset by the Q output of the reset one-shot 66. The flash one-shot 63 serves to generate a pulse for enabling the flash circuit 95, the width of this pulse being set by the values of the capacitor 64 and the potentiometer 65. The default settings of the circuits 63, 66 and 70 are such that their Q outputs are all normally low. Thus, the input terminal 2 of the one-shot 63 is held low, causing it to ignore any pulses received at its input terminal 1 from the ignition sensor circuit 41. Each time the photodiode 25 detects the reflected beam R from the tape patch 19 a "ready" pulse is emitted from the output of the light emitter/detector circuit 80, setting the flip-flop 70 and causing its Q output to go high. This allows the one-shot 63 to recognize pulses received from the ignition sensor circuit 41. The leading edge of the next pulse from the ignition sensor circuit 41 causes the Q output of the flash one-shot 63 to go high for an interval determined by the capacitor 64 and potentiometer 65. This pulse is sent to the flash circuit 95 to flash the xenon lamp 23. The output pulse from the flash one-shot 63 is also applied to the input terminal 2 of the reset one-shot 66 and the trailing edge of that pulse causes the Q output of the one-shot 66 to go high for an interval determined by the values of the resistor 67 and the capacitor 68. This "reset" pulse resets the flip-flop 70, causing its Q output to return low, thereby disabling the one-shot 63, causing it to ignore further pulses from the ignition sensor circuit 41 until the next "ready" pulse on the next revolution of the flywheel 13. Thus, upon each passage of the tape patch 19 beneath the incident visible laser beam I, the trigger circuit 60 is enabled to respond to only the very next ignition event.

Preferably, the knock sensor 35 is placed on the engine block as close as possible to the no. 1 cylinder combustion chamber, to minimize any propagation delays. It will be appreciated that a four-cycle diesel engine passes TDC twice during the interval between two consecutive combustions of the no. 1 cylinder. Thus, the xenon lamp 23 will flash not only in response to the no. 1 cylinder combustion, but also in response to the combustion in the cylinder which fires 360° from the no. 1 cylinder, i.e., cylinder no. 4 in a 4-cylinder engine of 1-3-4-2 firing order, or cylinder no. 6 in an 8-cylinder engine of 1-8-4-3-6-5-7-2 firing order. Thus, the timing light will produce a double flash, one for the no. 1 cylinder combustion and another, delayed one revolution, for the combustion of the opposing cylinder. While this requires some level of human reasoning to discard the second flash, it can also be beneficial. Thus, if it is not physically possible to affix the knock sensor 35 near the no. 1 cylinder, it may be possible to affix it near the opposing cylinder and to determine base timing in terms of this opposing cylinder.

The LED's 28 and 29 are useful in diagnosing trouble conditions if the xenon lamp 23 fails to flash. Thus, if the LED 29 is flashing consistently, this indicates that it is properly receiving the reflected signal R, otherwise it is not. The LED 28 should also be flashing consistently if it is properly sensing the ignition events. If the LED 28 does not flash and the connections are good, or if it remains on constantly, this indicates that the ignition sensor circuit 41 is out of adjustment. It can be adjusted by adjusting the potentiometer 56, which might be done by the use of a screwdriver through a hole in the housing 21. While a visible laser source is preferred to provide the incident beam I, it may be possible to use other types of light sources.

From the foregoing, it can be seen that there has been provided an improved diesel timing light which can be triggered by a vibration sensor on the engine and is controllable to respond to only ignition events of interest and to ignore others.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. In a timing light, which includes a flash circuit for producing a flash of illumination in response to an ignition event of interest in of an internal combustion engine, the improvement comprising: a trigger circuit coupled to the flash circuit for enabling the flash circuit only in the presence of an enable signal, and a sensing circuit adapted to be coupled to the engine for sensing a predetermined position of the engine other than its position at the ignition event of interest to indicate that the ignition event of interest is about to occur and responsive to such sensing for generating the enable signal.

2. The timing light of claim 1, and further comprising means optically coupling said sensing circuit to the associated engine.

3. The timing light of claim 2, wherein said means optically coupling includes means for causing an optical signal from the associated engine immediately before the ignition event of interest.

4. The timing light of claim 1, and further comprising vibration sensing means responsive to vibrations resulting from the pressure of cylinder combustion for detecting the ignition event.

5. The timing light of claim 4, wherein said vibration sensor is a knock sensor.

6. The timing light of claim 1, wherein said trigger circuit includes a timing circuit for disabling the flash circuit between first and second ignition events immediately following the generation of the enable signal.

7. The timing light of claim 6, wherein said timing circuit includes means responsive to the production of the flash of illumination in response to the first ignition event following the generation of the enable signal for disabling the flash circuit.

8. A timing light comprising: an ignition sensor adapted to be coupled to an associated engine for sensing ignition events, a first light source, a flash circuit coupled to said ignition sensor and to said first light source for producing a flash of illumination in response to an ignition event, a trigger circuit coupled to said flash circuit for enabling said flash circuit only in the presence of an enable signal, a second light source emitting a beam of light, and a photosensing circuit coupled to said trigger circuit and responsive to a reflected beam of light for generating the enable signal.

9. The timing light of claim 8, wherein said first light source is a xenon lamp.

10. The timing light of claim 8, wherein said second light source is a visible laser source.

11. The timing light of claim 8, and further comprising an indicator for indicating when said photosensing circuit is sensing the reflected light beam.

12. The timing light of claim 8, and further comprising an indicator for indicating when said ignition sensor is sensing an ignition event.

13. The timing light of claim 12, wherein said ignition sensor includes an adjustable-gain amplifier, said indicator providing an indication that said amplifier requires adjustment.

14. Apparatus for controlling a timing light for use with an internal combustion engine which has periodic ignition events and which includes an accessible member rotatable through an integer number of revolutions during each engine operating cycle and bearing a first indicium which aligns with a fixed second indicium on the engine once during each revolution of the member, said apparatus comprising: an ignition sensor coupled to the engine for sensing ignition events, a first light source, a flash circuit coupled to said ignition sensor and to said first light source for producing a flash of illumination in response to an ignition event, a trigger circuit coupled to said flash circuit for enabling said flash circuit only in the presence of an enable signal, a second light source adapted for directing an incident beam of light onto the accessible member, a reflective portion on the accessible member disposed so as to be illuminated by the incident beam of light once during each revolution of the member to produce a reflected beam of light, said reflective portion being so positioned on the member that the reflective portion aligns with the second indicium just prior to alignment of the first indicium with the second indicium, and a photosensing circuit coupled to said trigger circuit and disposed in the path of said reflected beam of light for generating the enable signal in response to the reflected beam of light.

15. The apparatus of claim 14, wherein said ignition sensor includes a vibration sensor for sensing vibrations resulting from the pressure of cylinder combustion.

16. The apparatus of claim 14, wherein said second light source includes a visible laser source.

17. The apparatus of claim 14, wherein said reflective portion includes a piece of reflective tape adhered to the accessible member.

18. The apparatus of claim 17, wherein said reflective tape is at least one square inch in area and is positioned approximately one inch ahead of the first indicium.

19. The apparatus of claim 14, and further comprising an indicator for indicating when said photosensing circuit is detecting the beam of light.

20. The apparatus of claim 14, and further comprising an indicator for indicating when said ignition sensor is sensing an ignition event.

* * * * *